US006308355B1

(12) United States Patent
McMillan et al.

(10) Patent No.: US 6,308,355 B1
(45) Date of Patent: Oct. 30, 2001

(54) MULTIPURPOSE EMERGENCY TOOL

(75) Inventors: Stewart G. McMillan, Valparaiso; David J. Kolacz, Plymouth; Rodney A. Carringer, LaPorte; James H. Walker, Valparaiso, all of IN (US)

(73) Assignee: Task Force Tips, Inc., Valparaiso, IN (US)

( * ) Notice: Subject to any disclaimer, the term of this patent is extended or adjusted under 35 U.S.C. 154(b) by 0 days.

(21) Appl. No.: 09/517,395

(22) Filed: Mar. 2, 2000

(51) Int. Cl.[7] ..... B25F 1/00
(52) U.S. Cl. ..... 7/142; 7/161; 7/166
(58) Field of Search ..... 7/142, 161, 166

(56) References Cited

U.S. PATENT DOCUMENTS 4,646,378 * 3/1987 Borden .
4,918,820 4/1990 Korb et al. .
5,247,715 * 9/1993 Nishiguchi .
5,315,724 * 5/1994 Trujillo et al. .
5,428,853 * 7/1995 Menke et al. .

OTHER PUBLICATIONS

Action Coupling & Equipment, Inc., Action—Municipal and Industrial Couplings and Adapters, 2pgs.
Agree's Bicycles, The Alien and McGuyver Tool, 1 pg., 1999.
Akron Brass®, Catalog 108, 3 pgs., 1998.
Akron Brass®, Catalog 106, 3 pgs., 1987.
AWG, Feuerwehrarmaturen, Für Brandschutz, Mobile Wasserversorgung und Industrie, Catalog No. 213, 6 pgs.
AWG, Fire Fighting Fittings for Fire Protection, Mobile Water Supply and Industry, 4 pgs.
AWG Storz System, Quick Connection Couplings, Catalog No. 114e, 3 pgs.
Bike World, Tools, Lubricants and Shop Essentials, 5 pgs., 1999.
Bryan's Fire & Rescue Specialists, Inc., Photocopy of wrench, 2 pgs.
W.S. Darley & Co., Fire Fighting Equipment, Catalog #223, 3pgs.
W.S. Darley & Co., Fire Fighting Equipment Catalog, Catalog #224, 5 pgs.
Elkhart, Fire Protection Equipment of All Types of Buildings, Catalog 78, 4 pgs.
Elkhart, Fire Fighting Equipment, Catalog B, 3 pgs.
Elkhart, Fire Fighting Equipment, Catalog T, 3 pgs.
Heiman Fire Equipment, Wrenches, 2 pgs., 1999.
Iowa–American Firefighting Equipment Co., A Tradition of Innovation, Catalog 6, 4 pgs.
Lenox, Tri–Fold Saw, 1 pg., 1999.
Liberty Industrial, Newco: Spanner Wrench, 1 pg., 1999.
Micro–Tools, Spanner Wrench, Economy Set, 1 pg., 1999.
Millennium Suppliers, Drum Wrench, 1 pg., 1999.
PC Voyage, Universal Utility Tool, 3 pgs., 1999.
Pok S.A., Raccords Couplings, 3 pgs.
Pollard, Hydrant Wrenches, 2 pgs., 1999.
R. Pons, Catalogue 1994, 6 pgs.
R. Pons, Catalogue 1996, 5 pgs.
Tri–Resq–Saw, Photocopy of wrench, 1pg.
South Park Corporation, Hydrant/Spanner Wrench/Holder, 2 pgs., 1999.
Yu Hwa Co., Ltd., Hex Key Wrenches, 2 pgs., 1999.

* cited by examiner

*Primary Examiner*—Timothy V. Eley
*Assistant Examiner*—Willie Berry, Jr.
(74) *Attorney, Agent, or Firm*—Lathrop & Clark LLP

(57) ABSTRACT

A multipurpose tool for use by firefighters and emergency personnel. The tool including a spanner wrench claw for turning firefighting hose connections, a wrench slot for turning natural gas valves, a glass-breaking spike, an open slot cutter for cutting seat belts and the like, and a foldable handle having an end shaped to be used as a pry bar.

24 Claims, 4 Drawing Sheets

MULTIPURPOSE EMERGENCY TOOL

FIELD AND BACKGROUND OF THE INVENTION

This invention relates generally to multipurpose tools, and more particularly to multipurpose tools for emergency personnel such as firefighters. The multipurpose tool of the present invention includes, among other things, tools for firefighting and for vehicle rescue operations.

Multipurpose tools are known, which include many different tools, such as cutting blades, wrenches, screw drivers, knife blades, and even eating utensils. Firefighters have for many years used different tools in various emergency situations. For fighting fires, spanner wrenches are used to connect and disconnect firefighting hose connections. Some spanner wrenches even include a slot that is adapted to close gas valves and prevent explosions in a fire situation. Some spanner wrenches have tapered handles for prying windows and doors to access buildings. When designed to pry objects, the handles are typically arcuate in shape to provide improved leverage. Occasionally, spanner wrenches have folding handles that make the size of the tool smaller for easier carrying in a pocket or tool chest. When not foldable, spanner wrenches oftentimes have loops for hooking to a belt. Other spanner wrenches include relatively broad hammer heads for pounding objects when necessary.

When other types of emergencies, such as vehicular accidents, are encountered, rescue personnel use specialty window breaking tools, seat belt cutters, and saws. One such tool combines a folding saw with an open slot and a glass-breaking spike in the handle. The open slot has in it a razor blade that cuts seat belts or other body restraints to free victims. The slotted position of the razor blade reduces the chance that the victim will be accidently cut.

Glass removing tools are also available that include folding blades for cutting weather stripping, a glass breaking spike, a spring-loaded window punch, and a serrated glass cutter that cuts glass like a saw.

All of the known tools are useful in their respective emergency or rescue situations, but none is designed or intended to be used in a variety of emergency situations. Thus, there is a need for a multifunction tool in a diverse variety of emergency situations.

SUMMARY OF THE INVENTION

The present invention is a multipurpose tool for use in a variety of emergency situations. For firefighting, the multipurpose tool includes a spanner wrench claw for connecting firefighting hose connections, a slot for closing gas valves, and a tapered handle for jimmying doors and windows. For vehicular rescue operations, the tool includes a spike for safely breaking glass and a razor blade in an open ended slot for cutting seat belts. The handle of the tool is foldable for easy transport in a pocket or tool box.

In accordance with the present invention, there is provided one embodiment of a multipurpose tool that includes: a handle; a spanner wrench claw joined to the handle; and a glass-breaking spike. The handle may be joined to the spanner wrench claw for pivoting movement between open and closed positions. When in the closed position, the glass-breaking spike may be concealed by the handle so that the spike can not tear clothes or cause other damage when not in use. The tool may include a lock for releasably securing the handle and spanner wrench claw in the open position.

In addition, the multipurpose tool may include a slot for closing natural gas main valves. An open slot may include a cutting blade such as a razor to cut seat belts or other material such as webbing or other fabrics.

Preferably, the tool's handle is arcuate in shape for improved leverage for prying. A distal end of the handle may be tapered to provide a convenient pry tool when the tool is opened and grasped at the spanner wrench claw. The tapered distal end of the handle may also include a transverse flare to provide improved load distribution.

A more detailed description of the preferred embodiment is provided below.

DETAILED DESCRIPTION OF THE DRAWINGS

Figure 1:
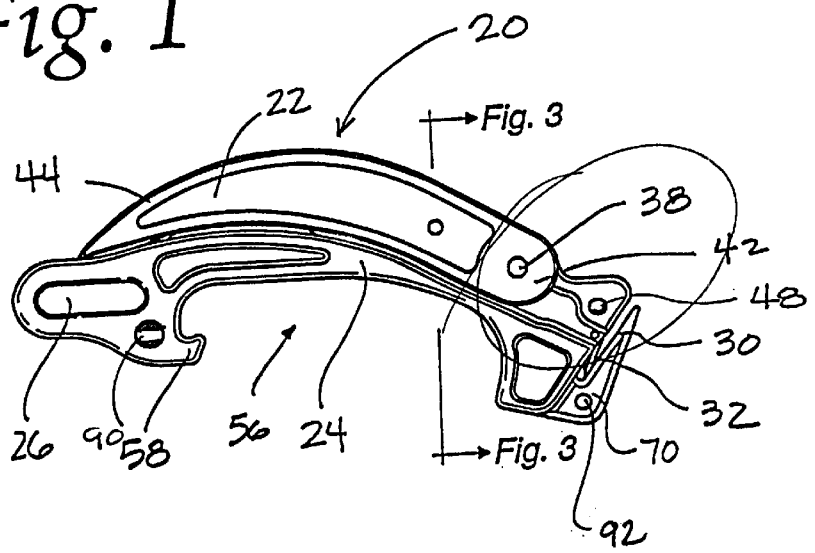
FIG. 1 is a side view of a multipurpose tool in a closed position in accordance with the present invention.
Figure 2:
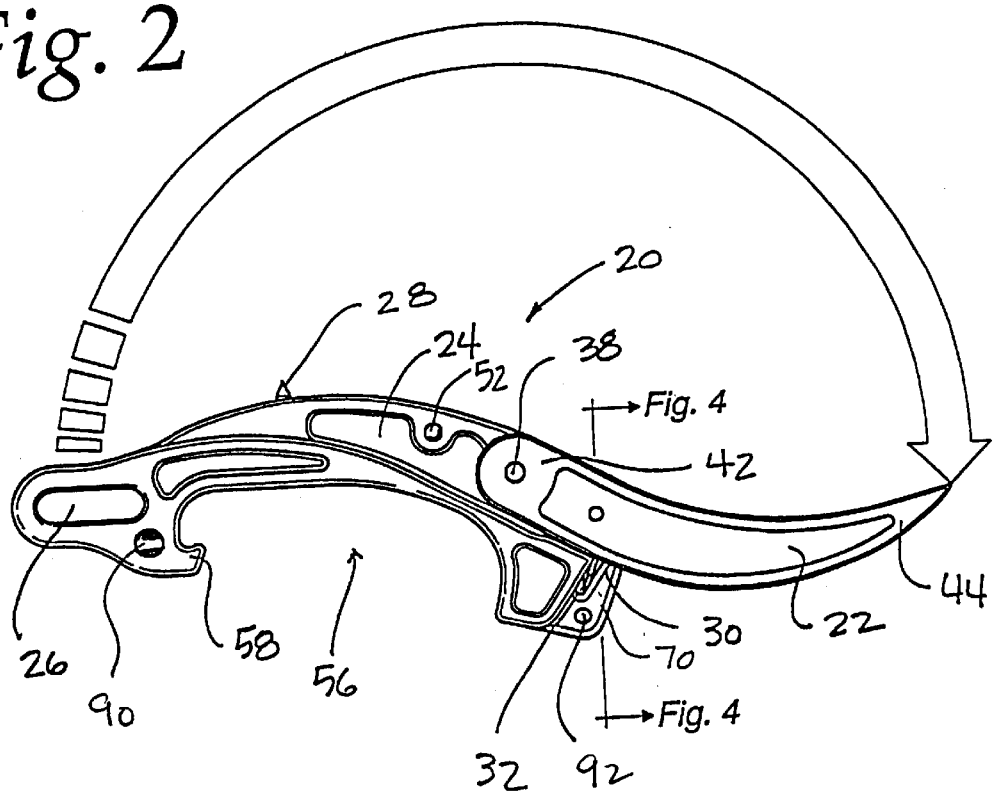
FIG. 2 is a side view of the multipurpose tool of FIG. 1 in an open position in accordance with the present invention.

In the following detailed description of the drawings, the same reference numeral will be used in each of the figures to identify the same element. FIGS. 1 and 2 illustrate a multipurpose tool 20 in accordance with the present invention. The multipurpose tool 20 includes: a handle 22, a spanner wrench claw 24, a wrench slot 26, a glass breaking spike 28, and an open slot 30 having disposed therein a cutting edge 32.

The handle 22 and spanner wrench claw 24 are preferably joined at a pivot point 38 about which the handle 22 and spanner wrench claw 24 can pivot between a closed position (FIG. 1) and an open position (FIG. 2). The handle 22 and the spanner wrench claw 24 are preferably made of Zytel® nylon available from DuPont. The pivot point 38 is preferably a stainless steel pin, but other forms of pivots can be used. The handle recess 61 mates with the spanner wrench claw 24 to make the tool 20 more compact in the closed position. Further, the handle 22 can be telescopic, retractable into the spanner wrench claw 24, or moveable in any other way to enable it to move between an open and closed position when such a feature is desired. Due to the relatively compact shape of the tool 20, even in the open position it is not necessary that the handle 22 be movable relative to the spanner wrench claw 24.

Figure 4:
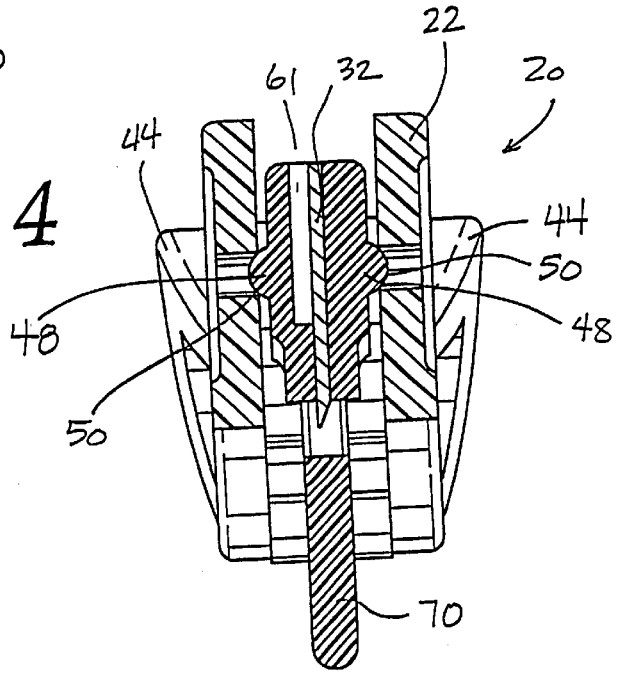
FIG. 4 is a cross-sectional view of the multipurpose tool in the open position taken along line 4—4 in FIG. 2.

The handle 22 includes a proximate end 42 and a distal end 44. The handle 22 is arcuate in shape for improved leverage when the tool 20 is being used as a pry bar. The handle 22 generally defines an arcuate axis along its length. The distal end 44 of the handle 22 is tapered in a direction parallel to the axis for prying closely fitted objects, such as window sashes and doors. As illustrated in FIG. 4, the distal end 44 of the handle 22 is flared in a direction transverse to the axis of the handle 22. This wider end of the tapered portion improves load distribution when prying objects or applying hand pressure on the handle 22 when the tool 20 is used as a wrench.

Figure 3:
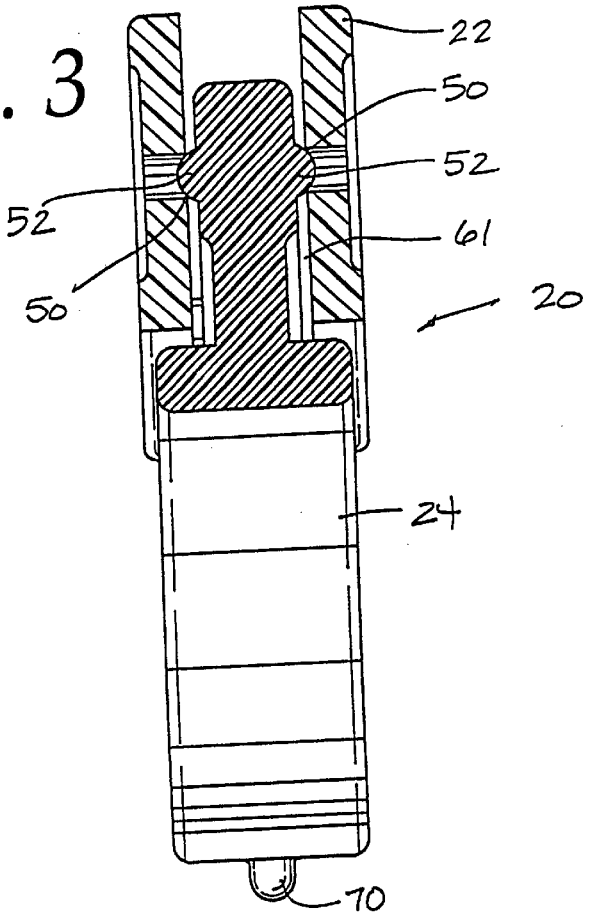
FIG. 3 is a cross-sectional view of the multipurpose tool in the closed position taken along line 3—3 in FIG. 1.

As illustrated in FIGS. 1 and 4, the handle 22 and the spanner wrench claw 24 are releasably locked in the open position by a pair of embossments 48 on the spanner wrench claw 24 that engages a corresponding pair of detents 50 on the handle 22. Similarly, as illustrated in FIGS. 2 and 3, the handle 22 and the spanner wrench claw 24 are releasably maintained in the closed position (FIG. 1) by a second pair of embossments 52 on the spanner wrench claw 24 that releasably engage the pair of detents 50. The embossments 48/52 and detents 50 releasably engage one another due to the resiliency and proportions of the materials used. A more affirmative locking mechanism (not illustrated) could be used either alone or in combination with the above-described lock. The alternate embodiment would be used to ensure desired placement of the handle 22 and spanner wrench claw 24 in either the open or closed position and require for example, two hands to effect the release. In this latter lock embodiment, the spanner claw 24 and handle 22 could not be accidently released from either position.

Figure 9:
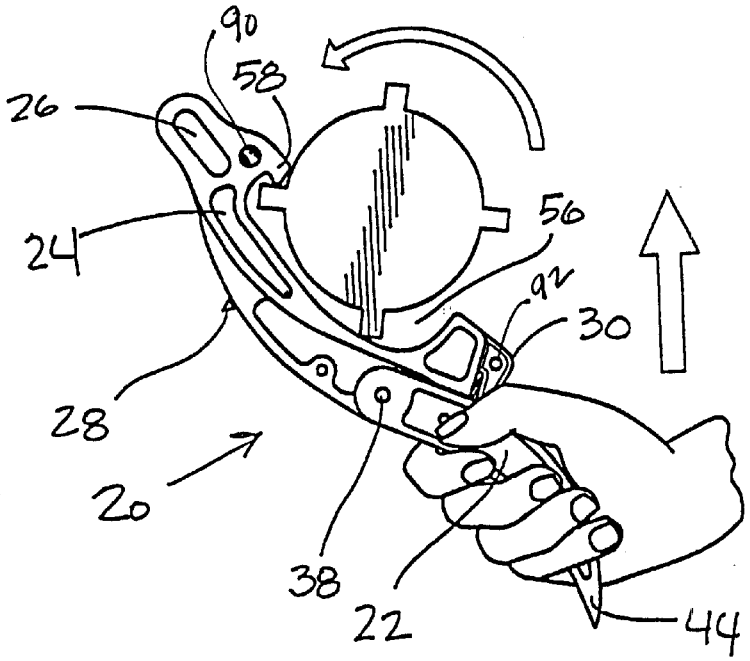
FIG. 9 is the multipurpose tool turning a hose fitting.

The spanner wrench claw 24, as illustrated in FIGS. 1 and 2, is also generally arcuate in shape and includes a roughly c-shaped opening 56 on its underside. The opening is terminated at the left side with a return lip 58 that engages firefighting hose connections to retain the fitting in the c-shaped opening 56 when the fitting is being turned. The right end of the c-shaped opening 56 is relatively open to accommodate fittings of various sizes. The spanner wrench claw 24 is preferably designed to work with rocker lug handline and supply line couplings, including four inch and five inch storz locking couplings by depressing the locks automatically when the wrench claw 24 is applied to and turning the coupling. In FIG. 9, the spanner wrench claw 24 and handle 22 are placed in the open position, a fitting 60 is placed in the c-shaped opening 56 so that the lip 58 engages the fitting 60. The multipurpose tool 20 is then rotated to turn the fitting 60 for a secure hose or pipe connection. Other spanner wrench configurations are possible and are within the scope of the present invention.

As illustrated in FIGS. 1 and 2, the spanner wrench claw 24 includes a wrench slot 26 at the left end for engaging valves on natural gas lines. The wrench slot 26 is elongated and closed at both ends to accommodate the shape of the valve, but it could be a variety of shapes in accordance with the present invention. Further, the wrench slot 26 is formed in the spanner wrench claw 24 and is, therefore, made of the same material. When this material is relatively soft, the wrench slot 26 may be lined with a hard plastic, metal, or other material to resist deformation. Also, by forming the wrench slot 26 in the end opposite the handle 22, the greatest degree of leverage is obtained. If leverage is not critical, the wrench slot 26 can be positioned elsewhere on the multipurpose tool 20. Finally, the wrench slot 26 need not pass completely through tool 20, but can instead be simply recessed deep enough in the tool 20 to accommodate a gas valve.

Figure 8:
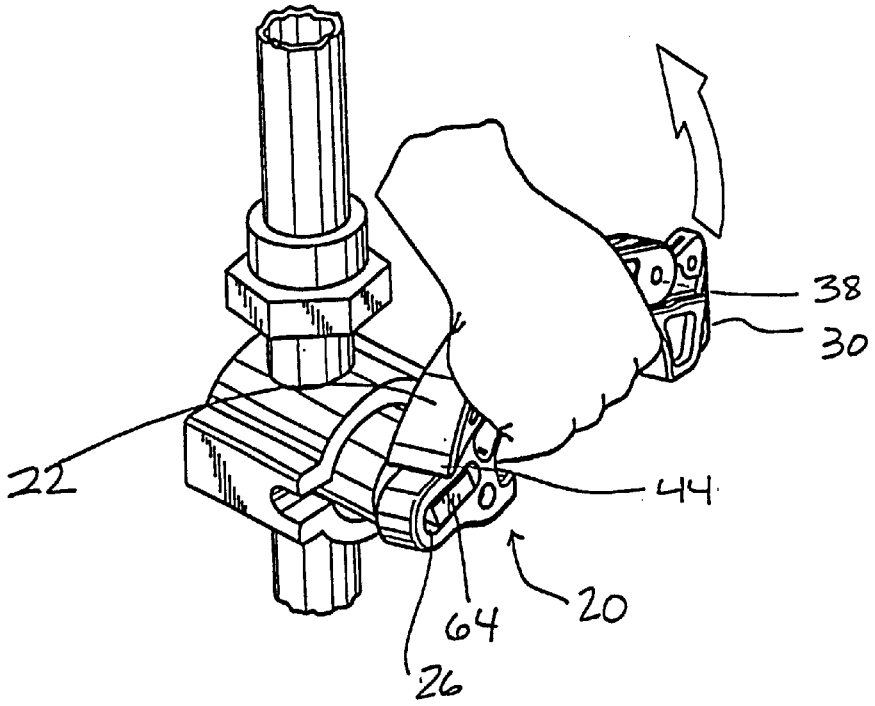
FIG. 8 is the multipurpose tool closing a gas main valve.

FIG. 8 illustrates the wrench slot 26 in use with the handle 22 and spanner wrench claw in the closed position. A gas valve 64 is disposed in the wrench slot 26 and the tool 20 is pulled upward to close the valve 64. Additional leverage is available by opening the wrench claw 24 and handle 22 and applying pressure only on the handle 22.

Figure 6:
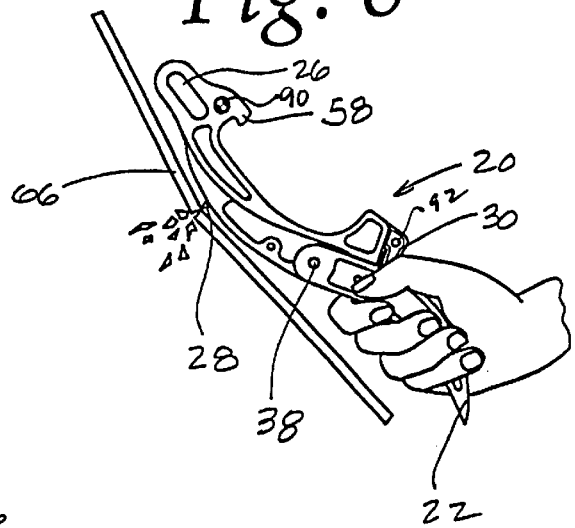
FIG. 6 is the multipurpose tool breaking glass.
Figure 7:
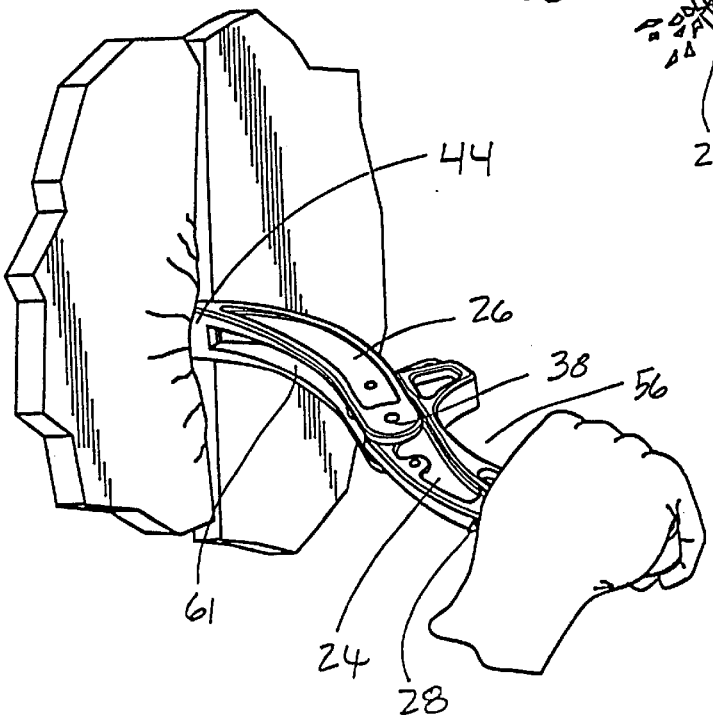
FIG. 7 is the multipurpose tool prying apart two objects.

Referring back to FIGS. 2 and 6, it will be apparent that the multipurpose tool 20 can be used in emergencies other than firefighting with reference to the glass-breaking spike 28 disposed on the outside of the arcuate spanner wrench claw 24. The spike is preferably made of a hard material such as hardened steel or carbide. The spike 28 is threaded into, pressed into, or secured there with a suitable adhesive, and can be permanently attached or be replaceable. When replaceable, the spike 28 can be threaded into the tool 20, for example. The spike 28 has an initial diameter of 3/16 inches and tapers uniformly down to nearly a point. This design concentrates the impact load on the desired location to maximize the stress applied to the glass 66 (in FIG. 6) for efficient breaking power. This arrangement further results in less flying glass and breakage in only the desired location to protect those in the vicinity from being cut.

The glass-breaking spike 28 is integral with the tool 20, such that it can be positioned anywhere on the tool 20, but it is preferably positioned as illustrated for being concealed in a handle recess 61 when the handle 24 is closed. This arrangement prevents the spike 28 from damaging anything when the handle 22 is closed and the tool 20 is not in use. The glass-breaking spike 28 may be retractable to accomplish this same objective, particularly when no folding handle is used or when the spike 28 is in another position on the tool 20. Preferably, the glass breaking spike 28 is made of carbide steel, C5 grade.

With the addition of the glass-breaking spike 28 to the multipurpose tool 20, the tool 20 becomes usable in a wider variety of emergency situations. The spanner wrench claw 24 and slot 26 are both for use in fighting fires, while the glass-breaking spike 28 can be used in fighting fires and for gaining access to injured people in vehicles.

Figure 5:
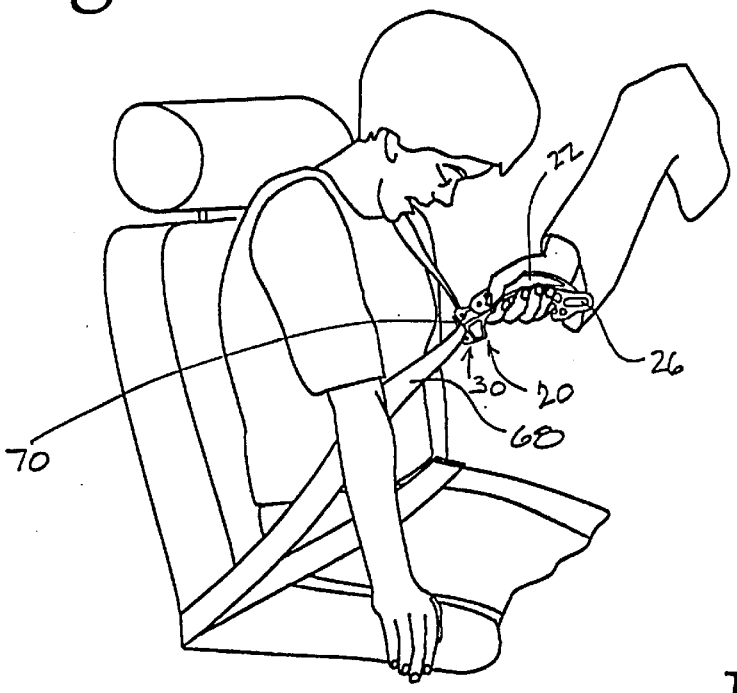
FIG. 5 is the multipurpose tool cutting a shoulder harness.

This latter function is supplemented by the open slot cutter 30, which is used to cut seat belts and shoulder harnesses 68 in vehicles to gain access to injured motorists and passengers. (FIG. 5.) The open slot cutter 30 is best illustrated in FIGS. 1 and 4. The open slot 30 is defined by a hook 70 formed in the spanner wrench claw 24. The hook 70 is relatively robust where it connects to, or is otherwise formed integrally with, the spanner wrench claw 24. At the opposite end, the hook 70 tapers to nearly a point so that it can readily hook into the material to be cut without being hung up on other materials. Disposed in the open slot cutter 30 is a cutting edge 32 such as a razor blade, preferably a blade made of stainless steel. The cutting edge 32 is preferably disposed at an angle to the hook 70, as illustrated, to form a deep v-shape in which the seat belt will be secured and efficiently cut. The cutting edge 32 can be molded into, press-fit, or otherwise embedded in the spanner wrench claw 24 and hook 70 using a suitable adhesive. The blade can be permanently attached to the tool 20, or secured in a way to be field replaceable by being, for example, sandwiched between screwed together halves of the tool 20.

As seen in FIG. 2, another wrench incorporated into the tool 20 is an oxygen bottle wrench 90 that is recessed into the spanner wrench claw 24. The oxygen bottle wrench 90 is essentially a slot formed in the molding process that fits the valve top of standard oxygen bottles used at emergency sites.

It is also possible that the multipurpose tool 20 can include wire cutters, saw blades, valve stem pullers, and other features for use in rescue operations. (Not illustrated.) Finally, a hole 92 is formed in the tool 20 to provide a connection for a lanyard or a key ring (not illustrated).

The materials specified above for use in the multipurpose tool provide sufficient strength and rigidity for most situations, while concurrently providing a lightweight tool that is easily manufactured and carried. Also, the proportions of the handle 22 and spanner claw provide additional rigidity and also substantial surface area on which information or advertising can be printed. It should be understood that the exact arrangement of the tool's functional features is not limited to the single embodiment depicted in the drawings. Further, the tool 20 as illustrated includes numerous ornamental features that add to the tool's distinctive look, separate and apart from the functional features described above.

The foregoing detailed description of the drawings is provided for clearness of understanding only, and is not intended to unnecessarily limit the claims below.

What is claimed is:

1. A multipurpose tool comprising:

a handle;

a spanner wrench claw joined to the handle; and an integral glass-breaking spike, wherein the spanner wrench claw is joined to the handle for movement between an open position and a closed position and, wherein the glass-breaking spike is concealed when not in use regardless of whether the spanner wrench claw is in the open or closed position.

2. A multipurpose tool comprising:

a handle;

a spanner wrench claw joined to the handle; and an integral glass-breaking spike, wherein the spanner wrench claw and the handle are joined for movement between an open and a closed position, and the tool further comprises a lock for releasably maintaining the spanner wrench claw and handle in the open position.

3. multipurpose tool of claim 2, wherein the glass-breaking spike is concealed when not in use.

4. The multipurpose tool of claim 1 or 2, wherein the spanner wrench claw defines a wrench slot.

5. The multipurpose tool of claim 1 or 2, wherein the spanner wrench claw defines an open slot, and further comprises a cutting edge disposed in the open slot.

6. The multipurpose tool of claim 1 or 2, wherein the handle includes a proximate end joined to the spanner wrench claw and a distal end that is tapered for prying.

7. The multipurpose tool of claim 1 or 2, wherein the handle is arcuate in shape, and includes a proximate end joined to the spanner wrench claw and a distal end that is tapered for use in prying.

8. The multipurpose tool of claim 1 or 2, wherein the handle defines an axis, and includes a proximate end joined to the spanner wrench claw, and a distal end that is tapered in a direction parallel to the axis and flared in a direction transverse to the axis.

9. The multipurpose tool of claim 1 or 2, wherein the glass-breaking spike is replaceable.

10. A multipurpose tool comprising:

a handle;

a spanner wrench claw joined to the handle for pivoting movement between an open position and a closed position; and a glass-breaking spike joined to the spanner wrench claw, wherein the glass-breaking spike is concealed when the spanner wrench claw and handle are in tie closed position.

11. A multipurpose tool comprising:

a handle;

a spanner wrench claw joined to the handle for pivoting movement between an open position and a closed position;

a glass-breaking bike joined to the spanner wrench claw; and a lock that releasbly maintaining the spanner wrench claw and handle in the open position.

12. The multipurpose tool of claim 11, wherein the glass-breaking spike is concealed when the spanner wrench claw and handle are in the closed position.

13. The multipurpose tool of claim 10 or 11, wherein the spanner wrench claw defines a wrench slot.

14. The multipurpose tool of claim 10 or 11, wherein the spanner wrench claw defines an open slot, and includes a cutting edge disposed in the open slot.

15. The multipurpose tool of claim 10 or 11, wherein the handle includes a proximate end joined to the spanner wrench claw and a distal end that is tapcred for prying.

16. The multipurpose tool of claim 10 or 11, wherein the handle is arcuate in shape, and includes a proximate end joined to the spanner wrench claw and a distal and that is tapered for prying.

17. The multipurpose tool of claim 10 or 11, wherein the handle defines an axis, and includes a proximate end joined to the spanner wrench claw and a distal end that is tapered in a direction parallel to the axis and flared in a direction transverse to the axis.

18. A multipurpose tool comprising:

a handle;

a spanner wrench claw joined to the handle;

an integral open slot; and a cutting edge disposed in the open slot, wherein the spanner wrench claw and the handle are joined for movement between an open position and a closed position, and the tool further comprises a lock for releasably maintaining the spanner wrench claw and the handle in the open position.

19. The multipurpose tool of claim 18, and further comprising:

an integral glass breaking spike.

20. The multipurpose tool of claim 19, wherein the glass-breaking spike is concealed when not in use.

21. The multipurpose tool of claim 18, wherein the spanner wrench claw defines a wrench slot.

22. The multipurpose tool of claim 18, wherein the handle includes a proximate end joined to the spanner wrench claw and a distal end that is tapered for prying.

23. The multipurpose tool of claim 18, wherein the handle defines an axis, and includes a proximate end joined to the spanner wrench claw, and a distal end that is tapered in a direction parallel to the axis and flared in a direction transverse to the axis.

24. The multipurpose tool of claim 18, wherein the cutting edge is replaceable.

* * * * *